US009176455B2

(12) United States Patent
Fujii

(10) Patent No.: US 9,176,455 B2
(45) Date of Patent: Nov. 3, 2015

(54) CLEANING APPARATUS, IMAGE FORMING APPARATUS, AND TONER CRUSHING MEMBER

(71) Applicant: Kyocera Document Solutions Inc., Osaka (JP)

(72) Inventor: Hirokazu Fujii, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/481,923

(22) Filed: Sep. 10, 2014

(65) Prior Publication Data

US 2015/0071691 A1 Mar. 12, 2015

(30) Foreign Application Priority Data

Sep. 10, 2013 (JP) ..... 2013-187475

(51) Int. Cl.
*G03G 21/00* (2006.01)
*G03G 21/10* (2006.01)

(52) U.S. Cl.
CPC ..... *G03G 21/0029* (2013.01); *G03G 21/105* (2013.01)

(58) Field of Classification Search
USPC ..... 399/343, 350, 351
See application file for complete search history.

(56) References Cited

U.S. PATENT DOCUMENTS

2013/0108341 A1* 5/2013 Ikebata et al. ..... 399/358

FOREIGN PATENT DOCUMENTS

JP 2005-077675 A 3/2005

* cited by examiner

*Primary Examiner* — Clayton E Laballe
*Assistant Examiner* — Warren K Fenwick
(74) *Attorney, Agent, or Firm* — James W. Judge

(57) ABSTRACT

A cleaning apparatus includes a blade, a screw, a toner crushing member, and a casing. The toner crushing member is located in contact with the screw. The toner crushing member is provided in association with the screw and configured to crush toner accumulated between the screw and the blade, by being swung by the screw rotating. The casing houses the screw and the toner crushing member. The screw rotates in the direction reverse to the rotational direction of the photoreceptor drum. The toner crushing member is configured having a first part and a second part, with a base-end side of the first part being secured to the casing, and the second part being folded back along a distal-end side of the first part, such that a distal-end side of the second part swings between the blade and the screw, in association with the rotation of the screw.

6 Claims, 5 Drawing Sheets

CLEANING APPARATUS, IMAGE FORMING APPARATUS, AND TONER CRUSHING MEMBER

INCORPORATION BY REFERENCE

This application is based upon, and claims the benefit of priority from, corresponding Japanese Patent Application No. 2013-187475 filed in the Japan Patent Office on Sep. 10, 2013, the entire contents of which are incorporated herein by reference.

BACKGROUND

Unless otherwise indicated herein, the description in this section is not prior art to the claims in this application and is not admitted to be prior art by inclusion in this section.

For example, an image forming apparatus, such as a laser printer and a multi-functional peripheral, includes a cleaning apparatus that removes remaining toner from an outer peripheral surface of a photoreceptor drum.

There is a cleaning apparatus that includes a blade, a screw, and a casing. The blade is slidably in contact with the outer peripheral surface of the photoreceptor drum in contact with the brush and separates the remaining toner from the outer peripheral surface of the photoreceptor drum. The screw conveys the toner separated from the photoreceptor drum. The casing houses the screw.

Usually, the blade and the screw are arranged separated from one another. Therefore, the toner separated from the photoreceptor drum is likely to accumulate between the blade and the screw. If the accumulated toner hardens, a flow of the toner heading from the blade to the screw is inhibited.

Therefore, the above-described cleaning apparatus includes a toner crushing member that crushes the toner accumulated between the blade and the screw. The toner crushing member is constituted of an elastic sheet material keeping in contact with the rotating screw. A base end side of the toner crushing member is secured to the casing while a distal end side of the toner crushing member is arranged between the blade and the screw.

Thus, the rotation of the screw swings the distal end portion of the toner crushing member. Accordingly, the toner accumulated between the blade and the screw is crushed with the distal end portion of the toner crushing member.

Here, in the cleaning apparatus, a rotation direction of the photoreceptor drum is the same as the rotation direction of the screw. Accordingly, the screw is in contact with the toner crushing member from the base end side to the distal end side, thus ensuring stable swing of the sheet-shaped toner crushing member.

SUMMARY

A cleaning apparatus according to the disclosure includes a blade, a screw, a toner crushing member, and a casing. The blade is configured to separate toner remaining on an outer peripheral surface of a rotating photoreceptor drum from the photoreceptor drum by slidably contacting the outer peripheral surface of the photoreceptor drum. The screw is configured to convey the toner separated from the photoreceptor drum by the blade, by rotating around an axis parallel to the rotational axis of the photoreceptor drum. The toner crushing member is provided in association with the screw. The toner crushing member therein is configured to crush toner accumulated between the screw and the blade, by being swung by the screw rotating. The casing houses the screw and the toner crushing member. The screw rotates in the direction reverse to the rotational direction of the photoreceptor drum. The toner crushing member is configured having a first part and a second part, with a base-end side of the first part being secured to the casing, and the second part being folded back along a distal-end side of the first part, such that a distal-end side of the second part swings between the blade and the screw, in association with the rotation of the screw.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
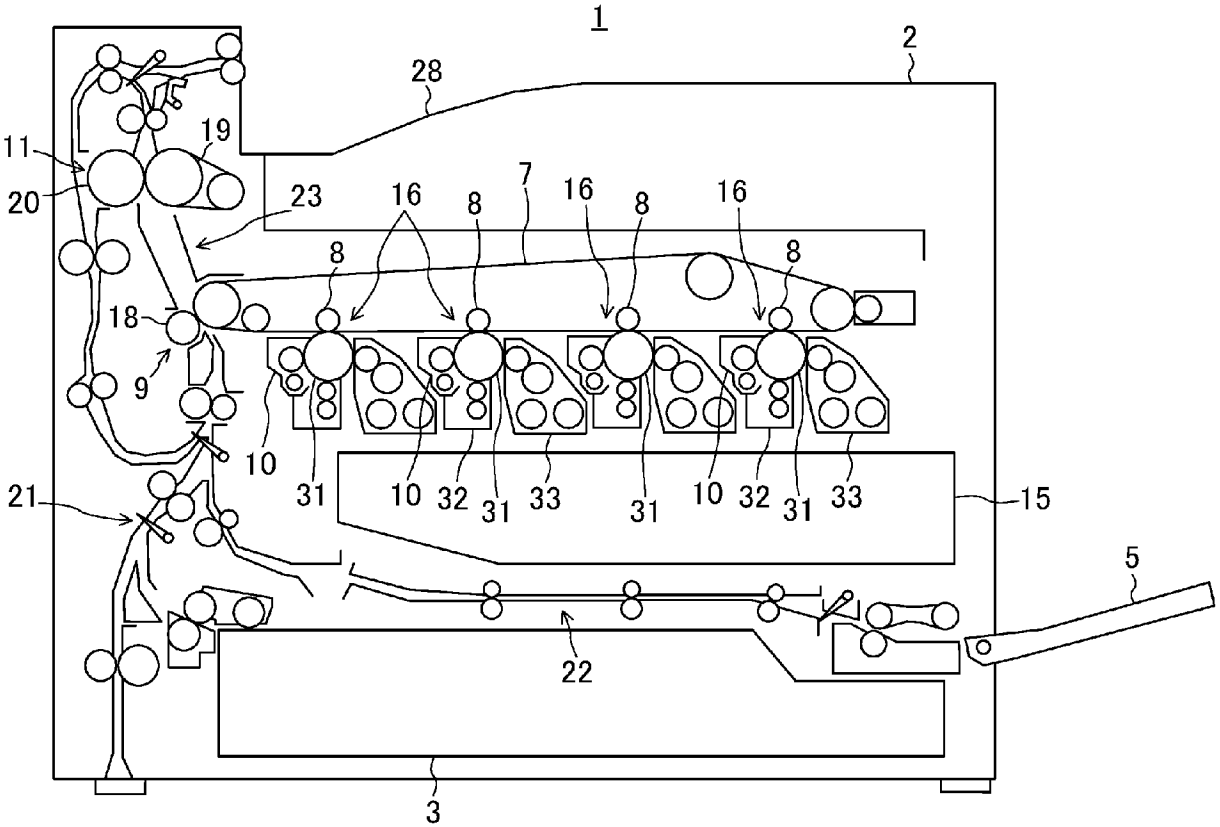
FIG. 1 illustrates a cross section of a schematic configuration of an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes an embodiment of the disclosure in detail based on the accompanying drawings. The disclosure should not be limited to the following embodiment.

Image Forming Apparatus

FIG. 1 illustrates a cross section of a schematic configuration of an image forming apparatus 1. The image forming apparatus 1 is, for example, a color printer of a tandem engine. As illustrated in FIG. 1, the image forming apparatus 1 includes an intermediate transfer belt 7, a primary transfer unit 8, a secondary transfer unit 9, a fixing unit 11, a light scanning device 15, and a plurality of image forming units 16.

The image forming apparatus 1 includes a sheet feed cassette 3 at a lower portion inside of a main body 2. The sheet feed cassette 3 internally loads and houses paper sheets (not illustrated) such as a cut paper before printing. A first paper sheet conveyor 21 is located at a side of the sheet feed cassette 3. The first paper sheet conveyor 21 receives the paper sheet sent out from the sheet feed cassette 3, and then conveys the paper sheet to the secondary transfer unit 9, which is located upward.

A manual paper feed tray 5 is located at a right side of the sheet feed cassette 3. At the left side of the manual paper feed tray 5, a second paper sheet conveyor 22 is located. The second paper sheet conveyor 22 receives the paper sheet or a similar sheet sent out from the manual paper feed tray 5 and conveys the paper sheet or a similar sheet to the first paper sheet conveyor 21.

The light scanning device 15 is arranged above the second paper sheet conveyor 22. The light scanning device 15 irradiates laser beam on the image forming units 16 based on image data received by the image forming apparatus 1. The image forming units 16 are located at an upper side of the light scanning device 15. The endless intermediate transfer belt 7 is located at the upper side of the respective image forming units 16. The intermediate transfer belt 7 is wound and hung around a plurality of rollers and is rotatably driven by a driving device (not illustrated).

The four image forming units 16 are arranged in a row along the intermediate transfer belt 7 as illustrated in FIG. 1. The four image forming units 16 form respective toner images of yellow (Y), magenta (M), cyan (C), or black (BK).

The image forming unit 16 includes a photoreceptor drum 31, which is a photoreceptor, a charger 32, a developing apparatus 33, and a cleaning apparatus 10, which are each arranged at a peripheral area of the photoreceptor drum 31.

The photoreceptor drum 31 is rotatably driven by a driving mortar (not illustrated). The charger 32 uniformly charges an outer peripheral surface of the photoreceptor drum 31 at a predetermined electric potential with a charging bias applied from a charging bias power source (not illustrated). Then, writing light emitted from the light scanning device 15 forms an electrostatic latent image on the respective photoreceptor drums 31.

The developing apparatus 33 houses respective toner with magenta, toner with cyan, toner with yellow, and toner with black. The developing apparatus 33 causes toner to adhere to the electrostatic latent image of the photoreceptor drum 31 depending on the respective colors develops the electrostatic latent image. Thus, the electrostatic latent images on the respective photoreceptor drums 31 are visualized as toner images.

The primary transfer units 8 are arranged at the upper side of the respective image forming units 16. The primary transfer units 8 include transfer rollers. The primary transfer rollers primarily transfer the toner images formed by the image forming units 16 to the surface of the intermediate transfer belt 7.

Here, remaining toner and a foreign object such as corona products adhere to the outer peripheral surface of the photoreceptor drum 31 from which the toner image has been transferred to the intermediate transfer belt 7. The cleaning apparatus 10 of the image forming unit 16 cleans the outer peripheral surface of the photoreceptor drum 31 to remove the remaining toner and the foreign object.

The intermediate transfer belt 7 is rotatably driven, and the toner images of the respective image forming units 16 are transferred to the intermediate transfer belt 7 at a predetermined timing. Then, a color toner image formed by mutually superimposing the toner images with four colors, yellow, magenta, cyan, and black, is formed at the surface of the intermediate transfer belt 7.

As illustrated in FIG. 1, the secondary transfer unit 9 includes a transfer roller 18 arranged at the left side of the intermediate transfer belt 7. The secondary transfer unit 9 causes the transfer roller 18 to transfer the toner image on the intermediate transfer belt 7 to a paper sheet.

The fixing unit 11 is located at the upper side of the secondary transfer unit 9. A third paper sheet conveyor 23 is formed between the secondary transfer unit 9 and the fixing unit 11. The third paper sheet conveyor 23 conveys the paper sheet on which the toner image has been secondarily transferred to the fixing unit 11.

The fixing unit 11 includes a fixing roller 19 and a pressure roller 20 that each rotate. The fixing unit 11 heats and pressurizes the paper sheet with the fixing roller 19 and the pressure roller 20 to fix the toner image on the paper sheet.

Thus, with the image forming apparatus 1, the light scanning device 15 light-scans the photoreceptor drum 31 based on the image data to form the electrostatic latent image on the photoreceptor drum 31. Afterwards, the developing apparatus 33 develops the electrostatic latent image of the photoreceptor drum 31 as toner images with respective colors. Next, the primary transfer unit 8 transfers the toner images with the respective colors from the photoreceptor drum 31 to the intermediate transfer belt 7. The secondary transfer unit 9 transfers the toner images on the intermediate transfer belt 7 to the paper sheet conveyed from the first paper sheet conveyor 21. Afterwards, the paper sheet on which the toner images have been fixed by the fixing unit 11 is discharged to a paper sheet discharge unit 28.

Cleaning Apparatus

Figure 2:
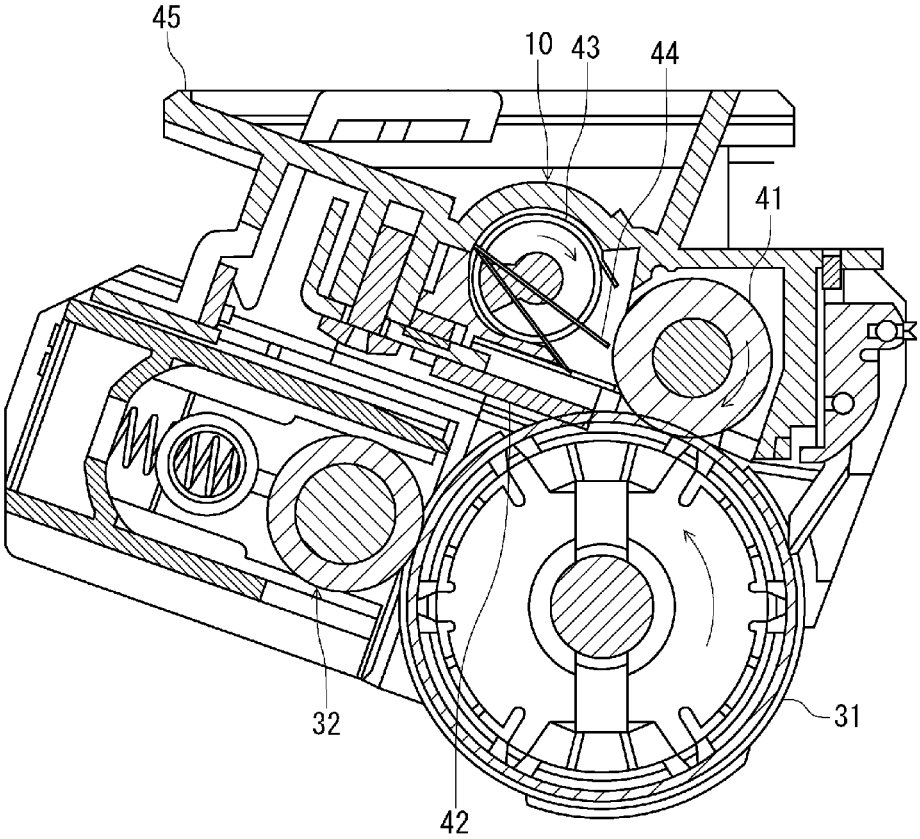
FIG. 2 illustrates a cross section of a cleaning apparatus, a charger, and a photoreceptor drum according to the one embodiment.
Figure 3:
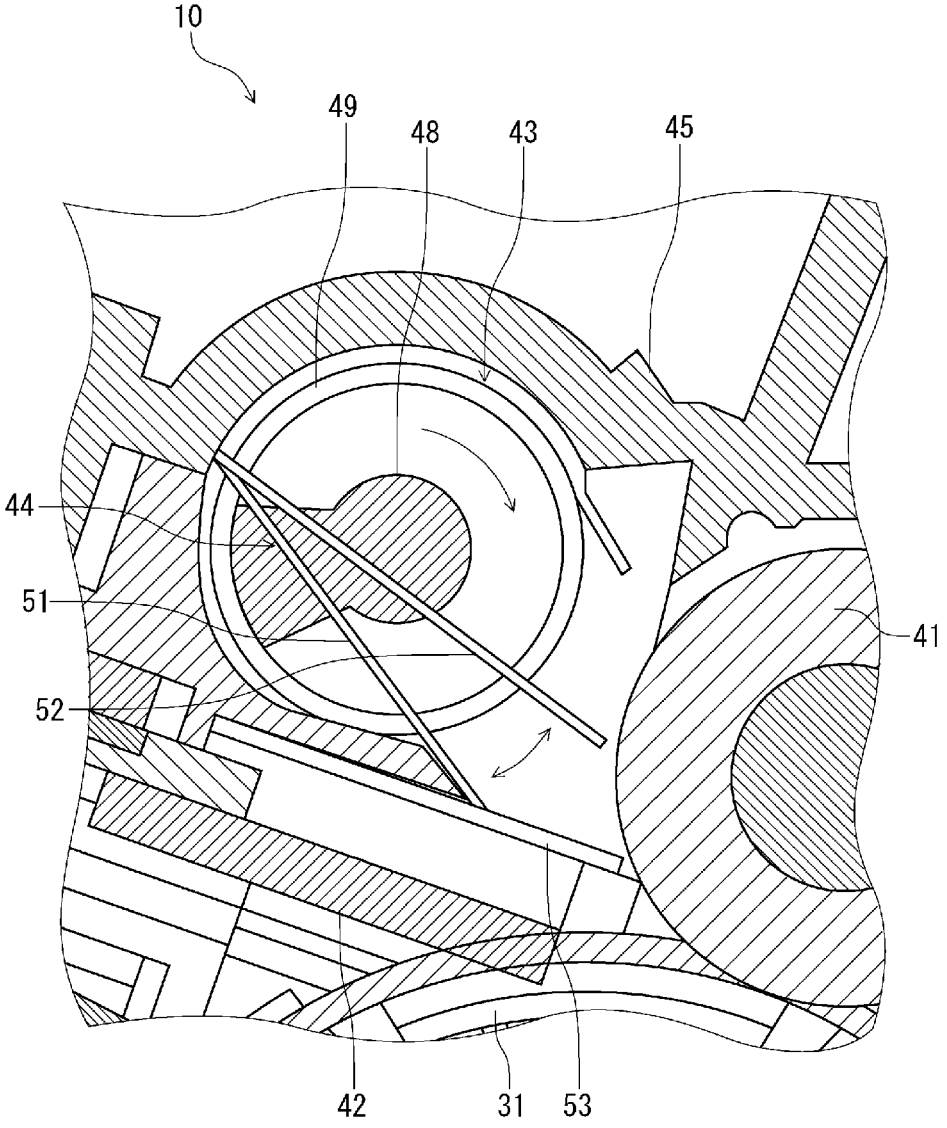
FIG. 3 illustrates an enlarged cross section of the cleaning apparatus according to the one embodiment.
Figure 4:
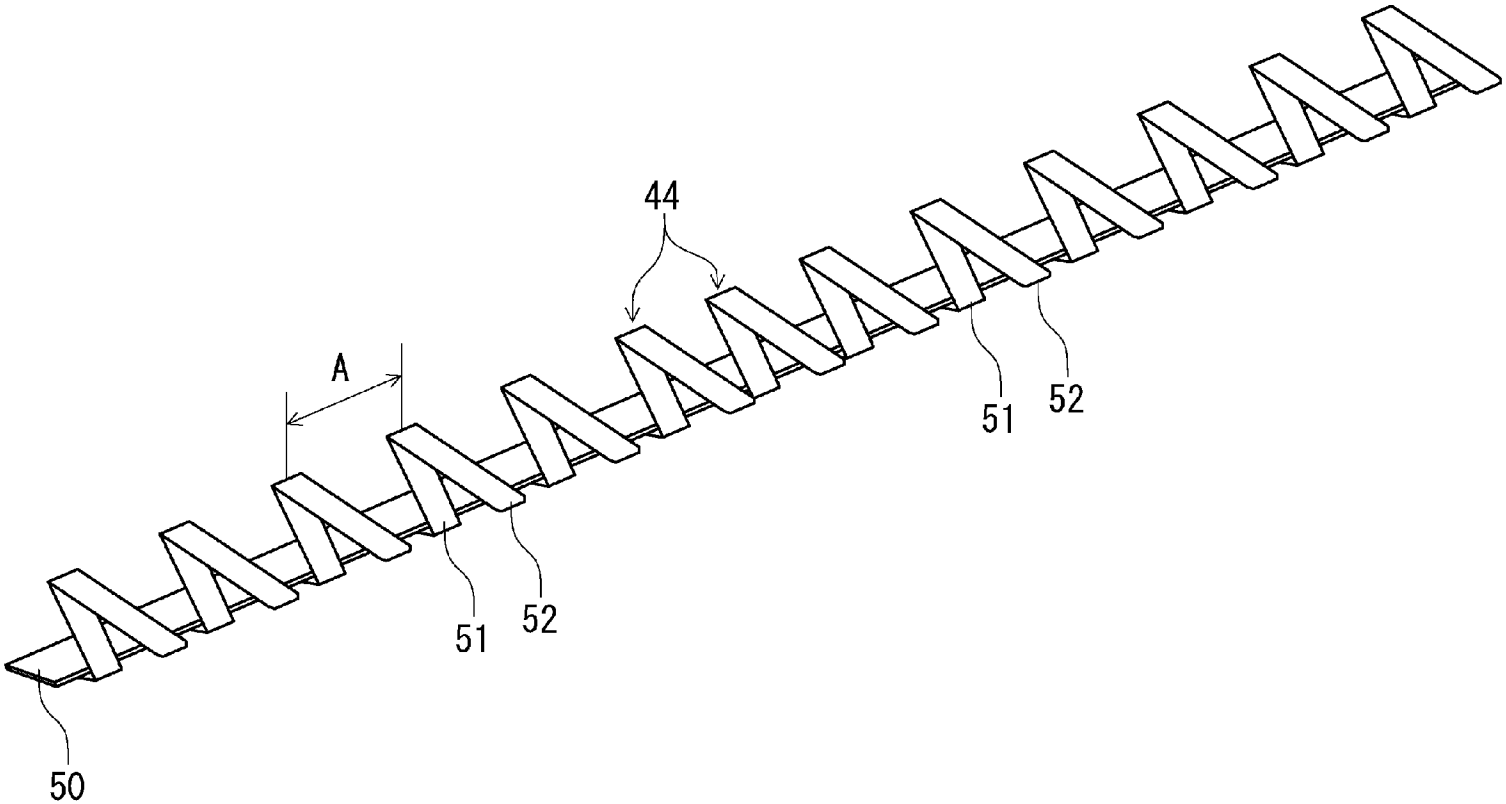
FIG. 4 perspectively illustrates an external appearance of a toner crushing member according to the one embodiment.
Figure 5:
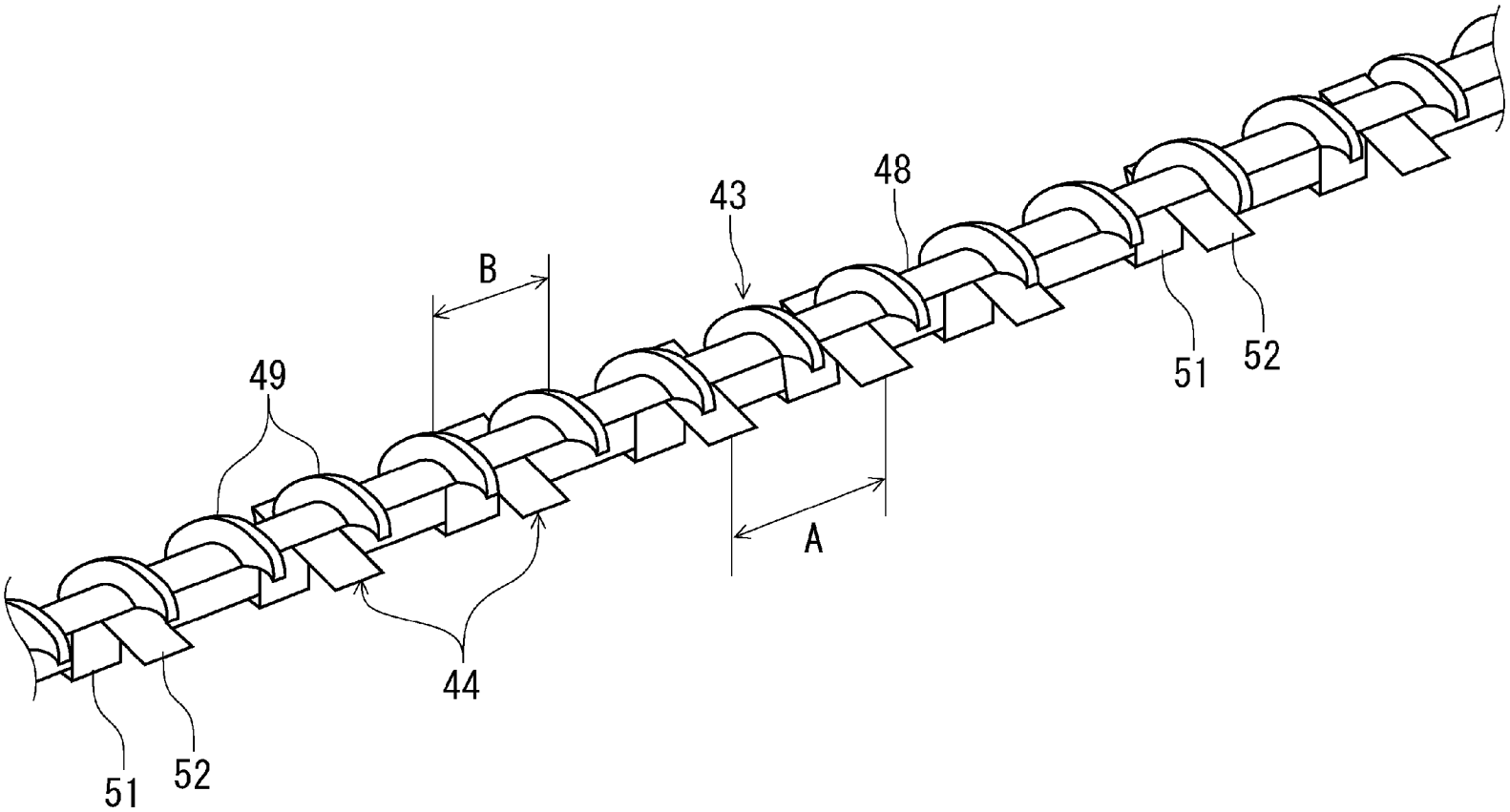
FIG. 5 perspectively illustrates the enlarged toner crushing member and a screw according to the one embodiment.

FIG. 2 illustrates structures of the cleaning apparatus 10, the charger 32, and the photoreceptor drum 31. FIG. 3 illustrates the enlarged cleaning apparatus 10. FIG. 4 illustrates an external appearance of a toner crushing member 44. FIG. 5 illustrates an enlarged toner crushing member 44 and a screw 43.

The cleaning apparatus 10, as illustrated in FIG. 2, includes a brush 41, a blade 42, the screw 43, the toner crushing member 44, and a casing 45. The casing 45, for example, houses the brush 41, the screw 43, and the toner crushing member 44.

The casing 45 rotatably supports both ends of the brush 41. The brush 41 rotates around an axis parallel to the photoreceptor drum 31 while being in contact with the outer peripheral surface of the photoreceptor drum 31. In FIG. 2, the photoreceptor drum 31 rotates anticlockwise. Meanwhile, the brush 41 rotates clockwise, which is the reverse direction of the photoreceptor drum 31.

The blade 42 is arranged such that a side end portion of the blade 42 abuts on the outer peripheral surface of the photoreceptor drum 31 in contact with the brush 41. Then, by slidably in contact with the outer peripheral surface of the rotating photoreceptor drum 31, the blade 42 causes the toner remaining on the outer peripheral surface of the photoreceptor drum 31 to separate from the photoreceptor drum 31.

The screw 43, as illustrated in FIG. 5, includes a shaft unit 48 and a spirally-patterned fin 49. The shaft unit 48 rotatably supports the casing 45. The fin 49 is integrally formed with the shaft unit 48 so as to be wound around the shaft unit 48.

The screw 43 rotates around an axis parallel to a rotation shaft of the photoreceptor drum 31. The screw 43 rotates in the reverse direction of the rotation direction of the photoreceptor drum 31, which is the clockwise direction in FIG. 2. Thus, the screw 43 conveys the toner separated from the photoreceptor drum 31 with the blade 42 in the axial direction of the shaft unit 48.

The toner crushing member 44 is located in contact with the screw 43. The rotation of the screw 43 swings the toner crushing member 44, thus crushing the toner accumulated between the screw 43 and the blade 42. The toner crushing member 44 is, for example, constituted of an elastic strip-shaped sheet material made of, for example, PET.

Accordingly, the fin 49 of the screw 43 is in contact from a base end side, which is a fixed end side of a first part 51, to a distal end side, which is a free end side. This ensures preventing entanglement of the toner crushing member 44 to the screw 43. Additionally, a second part 52 can preferably crush the toner accumulated between the blade 42 and the screw 43.

That is, with the embodiment, the toner accumulated between the blade 42 and the screw 43 can be efficiently conveyed to the screw 43, while the toner crushing member 44 can appropriately crush the toner between the blade 42 and the screw 43.

The toner crushing member 44, as illustrated in FIG. 2 to FIG. 5, includes the first part 51 and the second part 52. The base end side of the first part 51 is secured to the casing 45. The second part 52 is folded back at the distal end side of the first part 51. The second part 52 is longer than the first part 51. This ensures efficiently crushing the toner accumulated at a region distant farther from the screw 43 than the base end side of the first part 51, also further ensuring that the second part 52 is less likely to be wrapped up by the screw 43.

As illustrated in FIG. 4, a plurality of the toner crushing members 44 are arranged at a predetermined pitch A. A plate-shaped supporting member 50 supports the respective toner crushing members 44 at the base end side of the first part 51.

Here, as illustrated in FIG. 3, a bracket portion 59 is mounted and secured to the casing 45. The bracket portion 59 extends along the screw 43. A side surface of the bracket portion 59 opposed to the screw 43 is formed into a concave curved surface. On the other hand, a base end portion of a plate-shaped toner scraper 53 is mounted to a side surface opposite side from the screw 43 of the bracket portion 59.

The distal end portion of the toner scraper 53 is in contact with the brush 41. The toner scraper 53 scrapes off the toner adhered to the brush 41 to between the blade 42 and the screw 43 with its distal end portion. The toner scraper 53 has a plurality of openings (not illustrated). This causes the toner to pass through the screw 43 side from the blade 42 side via the openings.

The bracket portion 59 and the toner scraper 53 sandwich the supporting member 50 to which the toner crushing member 44 is mounted. Accordingly, the first part 51 of the toner crushing member 44 is secured to the casing 45 while the distal end side of the first part 51 and the second part 52 are freely swingable.

Thus, the toner crushing member 44 is constituted such that the distal end side of the second part 52 swings between the blade 42 and the screw 43 in association with the rotation of the screw 43. Accordingly, the distal end side of the second part 52 crushes the toner accumulated between the blade 42 and the screw 43.

Further, as illustrated in FIG. 5, the pitch A of the toner crushing members 44 differs from a pitch B of the fins 49 at the screw 43, thus the pitch A is larger than the pitch B.

This ensures shifting timing at which the fins 49 cause a plurality of the toner crushing members 44 to deflect and swing. Accordingly, a load applied to a driving mechanism for driving the screw 43 can be dispersed.

Thus, the blade 42 is slidably in contact with the outer peripheral surface of the photoreceptor drum 31 swept by the brush 41. Accordingly, the blade 42 separates the toner remaining on the outer peripheral surface of the photoreceptor drum 31 from the photoreceptor drum 31, thus the toner accumulates between the blade 42 and the screw 43. If the amount of accumulated toner increases, the toner passes through the openings of the toner scraper 53 from the blades 42 side and is extruded to the screw 43 side. The toner crushing member 44 stirs and crushes the toner extruded to between the toner scraper 53 and the screw 43.

Here, the fin 49 of the screw 43 is in contact with the toner crushing member 44. The rotation of the screw 43 causes the fin 49 to contact the first part 51 from the base end side to the distal end side of the first part 51. Accordingly, the distal end side of the second part 52 swings between the toner scraper 53 and the screw 43. Thus, the swinging second part 52 crushes a lump of the toner extruded to between the toner scraper 53 and the screw 43.

Thus, the toner extruded from the blade 42 side to the screw 43 side is crushed by the toner crushing member 44, moves to the screw 43, and then is conveyed by the screw 43.

This embodiment rotates the screw 43 to the reverse direction of the rotation direction of the photoreceptor drum 31. Accordingly, the screw 43 can take in the toner extruded from the blade 42 to the screw 43 along the extruded direction. This ensures efficiently conveying the toner separated from the photoreceptor drum 31 to the screw 43.

This embodiment describes the color printer as the exemplary image forming apparatus. However, this should not be constructed in a limiting sense. For example, the image forming apparatus may be another image forming apparatus that includes the light scanning device 15 such as a copier, a scanner device, or a multi-functional peripheral.

As described above, the disclosure is applicable to the cleaning apparatus, the image forming apparatus, and the toner crushing member.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A cleaning apparatus, comprising:

a blade configured to separate toner remaining on an outer peripheral surface of a rotating photoreceptor drum from the photoreceptor drum by slidably contacting the outer peripheral surface of the photoreceptor drum;

a screw configured to convey the toner separated from the photoreceptor drum by the blade, by rotating around an axis parallel to the rotational axis of the photoreceptor drum, the screw rotating in the direction reverse to the rotational direction of the photoreceptor drum;

a toner crushing member disposed in association with the screw such as to break up toner accumulation between the screw and the blade, by being swung by the screw rotating; and a casing that houses the screw and the toner crushing member; wherein the toner crushing member is folded over itself such as to be constituted by a first part and a second part, with a base-end side of the first part being secured to the casing, with the second part being folded back along a distal-end side of the first part, such that a distal-end side of the second part swings between the blade and the screw, in association with the rotation of the screw, and with the second part being of length such that its distal-end side is farther from the screw than the base-end side of the first part.

2. The cleaning apparatus according to claim 1, wherein:

the screw includes a shaft unit and fins each wrapping around the shaft unit, at a given pitch along the screw;

a plurality of the toner crushing members are arranged at a predetermined pitch along a supporting member; and the predetermined pitch of the toner crushing members differs from the given pitch of the fins along the screw.

3. An image forming apparatus, comprising:

a photoreceptor drum; and the cleaning apparatus according to claim 1.

4. A toner crushing member employable in the cleaning apparatus according to claim 1, comprising:

a first part having a base-end side configured to be secured to the casing; and a second part folded back along a distal-end side of the first part; wherein the toner crushing member is configured such that the distal-end side of the second part swings between the blade and the screw in association with the rotation of the screw.

5. An image forming apparatus that includes a photoreceptor drum and a cleaning apparatus, the cleaning apparatus being configured to clean an outer peripheral surface of the photoreceptor drum, wherein:

the cleaning apparatus includes a blade configured to separate toner remaining on the outer peripheral surface of a rotating photoreceptor drum from the photoreceptor drum by slidably contacting the outer peripheral surface of the photoreceptor drum, a screw configured to convey the toner separated from the photoreceptor drum by the blade by rotating around an axis parallel to the rotational axis of the photoreceptor drum, the screw rotating in the direction reverse to the rotational direction of the photoreceptor drum, a toner crushing member disposed between the screw and the blade, for breaking up toner accumulation therebetween, and a casing that houses the screw and the toner crushing member;

the toner crushing member is folded over itself such as to be constituted by a first part and a second part, with a base-end side of the first part being secured to the casing, and with the second part being folded back along a distal-end side of the first part and being of length such that its distal-end side is farther from the screw than the base-end side of the first part, the toner crushing member being disposed and configured such that by the screw being in contact with toner crushing member from the base-end side to the distal-end side of the first part, the distal end side of the second part is swung between the blade and the screw.

6. A toner crushing member employable in a cleaning apparatus, wherein:

the cleaning apparatus includes a blade configured to separate toner remaining on an outer peripheral surface of a rotating photoreceptor drum from the photoreceptor drum by slidably contacting the outer peripheral surface of the photoreceptor drum, a screw configured to convey the toner separated from the photoreceptor drum by the blade, by rotating around an axis parallel to the rotational axis of the photoreceptor drum in a direction reverse to that of the photoreceptor drum, and a casing that houses the screw;

the toner crushing member is disposed in association with the screw such as to break up toner accumulation between the screw and the blade, by being swung by the screw rotating;

the toner crushing member is folded over itself such as to be constituted by a first part and a second part, with a base-end side of the first part being secured to the casing, with the second part being folded back along a distal-end side of the first part, such that a distal-end side of the second part swings between the blade and the screw, in association with the rotation of the screw, and with the second part being of length such that its distal-end side is farther from the screw than the base-end side of the first part.

* * * * *